US011484140B2

(12) United States Patent
Giles

(10) Patent No.: US 11,484,140 B2
(45) Date of Patent: Nov. 1, 2022

(54) APPARATUS AND METHOD FOR A STORING A BASEBALL CAP

(71) Applicant: John Paul Giles, Lubbock, TX (US)

(72) Inventor: John Paul Giles, Lubbock, TX (US)

( * ) Notice: Subject to any disclaimer, the term of this patent is extended or adjusted under 35 U.S.C. 154(b) by 0 days.

(21) Appl. No.: 17/196,449

(22) Filed: Mar. 9, 2021

(65) Prior Publication Data

US 2021/0321806 A1 Oct. 21, 2021

Related U.S. Application Data

(63) Continuation-in-part of application No. 16/600,454, filed on Oct. 12, 2019, now Pat. No. 10,939,714.

(60) Provisional application No. 62/772,179, filed on Nov. 28, 2018.

(51) Int. Cl.
*A47G 25/10* (2006.01)
*A47G 29/10* (2006.01)

(52) U.S. Cl.
CPC ..... *A47G 25/10* (2013.01); *A47G 29/10* (2013.01)

(58) Field of Classification Search
CPC ..... A42B 1/002; A47F 7/06; A47B 81/00; A47G 25/10; A47G 29/10
See application file for complete search history.

(56) References Cited

U.S. PATENT DOCUMENTS 2,494,487 A * 1/1950 Pfeil ..... A47G 25/10 211/32
2,783,895 A * 3/1957 Lynch ..... A45C 11/02 211/32
3,178,030 A * 4/1965 Huebel ..... A47G 25/10 211/32
3,737,081 A * 6/1973 James ..... A42B 1/002 223/84
4,436,267 A * 3/1984 Eads ..... B65H 75/366 248/75
5,086,931 A * 2/1992 Cobb ..... A47F 7/06 211/32
5,163,589 A * 11/1992 Biehl ..... A42B 1/002 223/24
5,244,102 A * 9/1993 Koenig ..... A47G 25/10 211/32
5,303,829 A * 4/1994 Kennedy ..... A47F 7/06 211/30
5,344,003 A * 9/1994 Park ..... A47F 7/06 206/476
5,348,166 A * 9/1994 Lema ..... A47F 1/085 211/113
5,411,144 A * 5/1995 Deupree ..... A47F 7/06 211/30
5,480,073 A * 1/1996 LaManna ..... A47F 7/06 206/303
D368,168 S * 3/1996 Bennett ..... D6/320
5,566,837 A * 10/1996 Lema ..... A47F 7/06 211/31
5,683,002 A * 11/1997 Rayside ..... A47F 7/06 211/113
5,685,465 A * 11/1997 Berardis ..... A42B 1/002 211/30

(Continued)

*Primary Examiner* — Stanton L Krycinski

(74) *Attorney, Agent, or Firm* — G. Michael Roebuck; Moster Craft PC

(57) ABSTRACT

The present invention is a wall mountable apparatus that receives one or more baseball styled caps for compact storage.

9 Claims, 10 Drawing Sheets

(56) References Cited

U.S. PATENT DOCUMENTS 5,727,694 A * 3/1998 Larson ..... A47F 7/06 211/30
5,758,779 A * 6/1998 Atkins ..... A47F 7/06 211/30
5,862,522 A * 1/1999 Cho ..... A42C 1/06 223/51
5,921,403 A * 7/1999 Coffaro ..... A47F 7/06 211/32
5,991,927 A * 11/1999 Barbaccia ..... A42B 1/24 2/209.13
D436,742 S * 1/2001 Mueller ..... D6/315
6,273,274 B1 * 8/2001 Lyles ..... A47F 7/06 211/32
6,311,879 B1 * 11/2001 Rigler ..... A47F 7/06 211/30
6,422,400 B1 * 7/2002 Miller ..... A47F 7/06 211/183
6,422,401 B1 * 7/2002 Roten ..... A47F 7/06 211/32
6,510,972 B1 * 1/2003 Briskey ..... A42B 1/002 223/24
6,824,027 B2 * 11/2004 Frey ..... A42B 1/002 223/14
6,840,411 B2 * 1/2005 Fritz ..... A47G 25/10 223/24
7,185,770 B1 * 3/2007 Roten ..... A47B 81/00 211/70.6
7,665,616 B1 * 2/2010 Hobbie ..... A47F 7/06 211/31
8,231,034 B2 * 7/2012 Styles ..... A42B 1/002 223/12
10,264,896 B2 * 4/2019 Petner ..... A47F 7/06
10,988,086 B2 * 4/2021 Murray ..... B60R 7/10
2003/0029893 A1 * 2/2003 Fritz ..... A47F 7/06 223/24
2008/0296240 A1 * 12/2008 Napier ..... A47F 7/06 40/604
2009/0119819 A1 * 5/2009 Thompson ..... A42B 1/0182 2/209.13
2010/0230368 A1 * 9/2010 Slade ..... A47F 3/10 211/33
2017/0006948 A1 * 1/2017 Quinones ..... A42B 1/0183
2019/0315282 A1 * 10/2019 Murray ..... B60R 7/10
2019/0390397 A1 * 12/2019 Wynn ..... D06F 95/008

* cited by examiner

APPARATUS AND METHOD FOR A STORING A BASEBALL CAP

CROSS REFERENCE TO RELATED APPLICATIONS

This patent application takes priority from U.S. Provisional Patent Application No. 62/772,179 by John Giles filed on Nov. 28, 2018 and entitled A System, Apparatus and Method for A Cap Holder, and takes priority from U.S. patent application Ser. No. 16/600,454, now U.S. patent Ser. No. 10/939,714 filed on Oct. 12, 2019 and entitled APPARATUS AND METHOD FOR A STORING A BASEBALL CAP by John Giles, both of which are hereby incorporated by reference in their entirety.

BACKGROUND OF THE INVENTION

Many own and accumulate multiple baseball style caps. There is a need for an efficient storage system for these caps that accumulate.

FIELD OF THE INVENTION

The present invention relates to a storage system and method for a baseball style cap.

SUMMARY OF THE INVENTION

The present invention is a wall mountable apparatus that receives one or more baseball styled caps for compact storage.

BRIEF DESCRIPTION OF THE DRAWINGS

The invention will be better understood in reference to the following drawings, which are examples of an illustrative embodiment and are not limiting as different embodiments of the invention may be realized.

DETAILED DESCRIPTION OF THE INVENTION

In a particular illustrative embodiment of the present invention, a wall mountable apparatus is disclosed that receives one or more baseball styled caps for compact storage. The caps' bills slide into angular openings formed attached to a rigid base that does not deform the bill of the cap. Multiple caps can be stacked into each other for storage on the wall mountable apparatus. The bills can be flat or curved when stored in an illustrative embodiment of the present invention.

Figure 1:
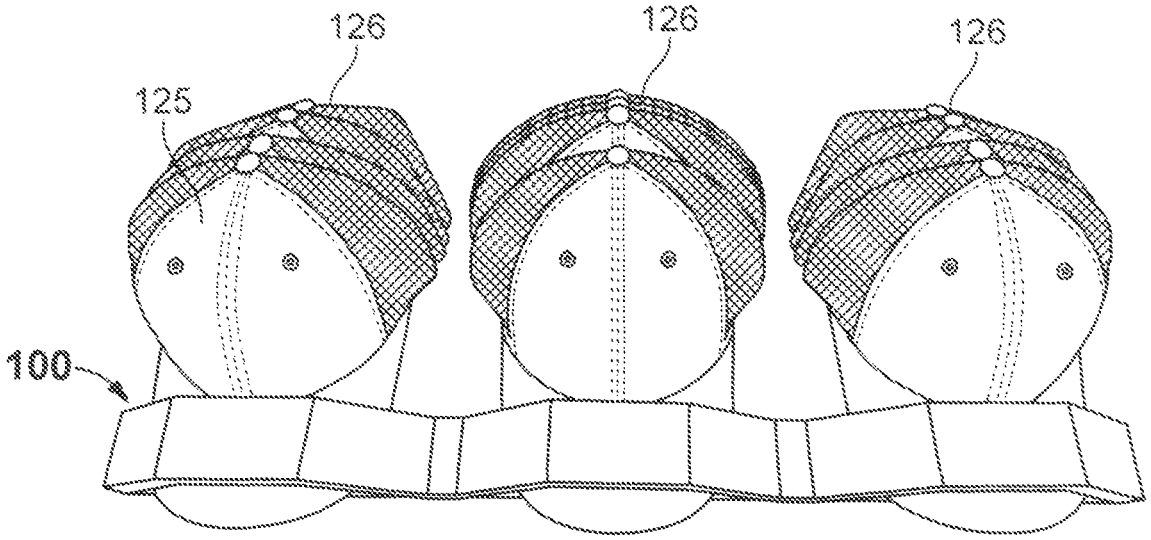
FIG. 1 is a top view of a depiction of a particular illustrative embodiment of the invention.

Turning now to FIG. 1, FIG. 1 is a side view of a depiction of a particular illustrative embodiment 100 of the invention. As shown in FIG. 1, in a particular illustrative embodiment of the invention three stacks 126 of baseball styled caps 125 are stored in particular illustrative embodiment 100 of the invention.

Figure 2:
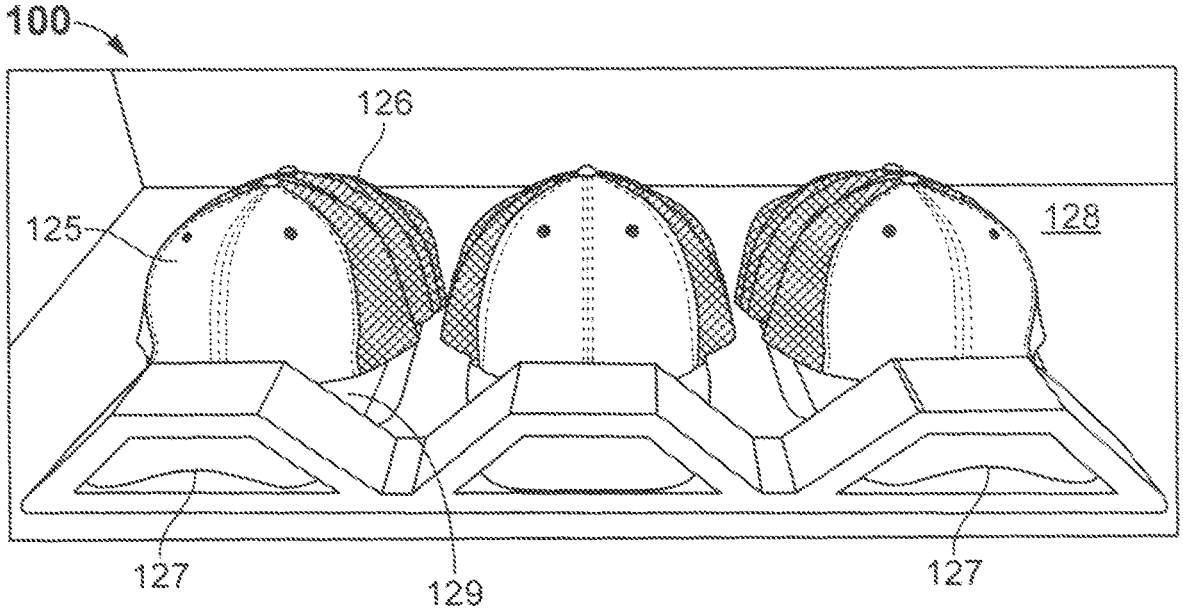
FIG. 2 is a side view of a depiction of a particular illustrative embodiment of the invention.

Turning now to FIG. 2, FIG. 2 is a side view of a depiction of a particular illustrative embodiment 100 of the invention, wherein each of the baseball style caps has an arcuate shaped bill 129, wherein each bill has a distal end away from the head piece or dome of the baseball cap, when a tip 127 of the bill 129 inserted into angular cap supports forming angular openings provided by the apparatus. In another particular embodiment of the invention, the cap support is arcuate shaped and thus the openings formed by the cap supports are not angular but are arcuate or curved accommodating a curved or flat baseball cap bill when inserted in the arcuate cap support. The angular opening 108 that receives the cap bill 129 is further described in detail in association with FIG. 3. The bill 129 fits loosely into the angular opening 108 for by the cap support (also referred to herein as a cap bill receiver) 108 without altering the shape of the bill which is personally formed by the owner of the baseball cap. The cap bill 129 may also be flat, arcuate concave or arcuate convex and still be inserted into the cap bill receiver 108 formed by the angular opening 108 in the apparatus. The cap supports provide angular openings 108 are formed by the cap support as a trapezoid having two parallel sides, one parallel side on the top and one parallel side on the bottom and two non-parallel sides on each end of the top and bottom that connects the top and bottom sides forming a trapezoid. The longer bottom parallel side is wide enough to accommodate the full width of the cap bill when the cap bill is flattened out and deep enough to hold the cap bill when the cap bill is formed in an arcuate shape. Thus, the longer bottom side is wider than the width of the cap bill when flat. The loose fit of the cap bill into the angular openings provided by the present invention preserves the arcuate shape of the bill 127 and preserves the shape of the cap bill, as cap's owner had previously shaped the bill into the cap owner's personally designed shape for the cap bill.

In another particular illustrative embodiment of the invention, the arcuate cap bill fits into the angular opening formed by the cap support without touching the sides of the angular opening formed by the cap support so that the cap bill is kept in the cap support opening by supporting the head piece or dome of the cap that covers a wearer's head. The dome of the cap and is attached to the bill of the cap so that the cap support supports the dome without deforming the cap bill while supporting the cap dome while stored in the apparatus. In another particular embodiment, the arcuate cap bill only lightly touches the angular opening at one point on a top or apex of the of the arcuate bill and two points on the bottom of the bill so that the cap bill fits into the cap support without deforming the shape of the cap bill. Each of the stack 126 of caps 125 domes are folded in half so that the back of the dome folds inside of the front of the dome and toward the cap bill, so that the folded dome slides loosely into another folded dome of another baseball cap already inserted into the angular opening. The first baseball cap inserted into the cap support has a folded dome so that the folded dome of the first cap receives and supports additional caps subsequently inserted into the first folded dome and stacked for storage in an arch. In a particular illustrative embodiment, the cap support is affixed to a wall 128 so that the stacks of caps are stored against a vertical wall to store the caps efficiently in a small volume of space without altering the shape of the bills of the caps. Stacks of caps each having a different cap bill shape are stacked in the apparatus without deforming the shape of the cap bills. A flat bill cap is inserted into an arcuate billed cap and stacked in the arch. A second and subsequent cap is stored by sliding the second cap bill and folded dome or head piece into the first cap dome that has already been inserted into the angular opening (arch) 108.

Figure 3:
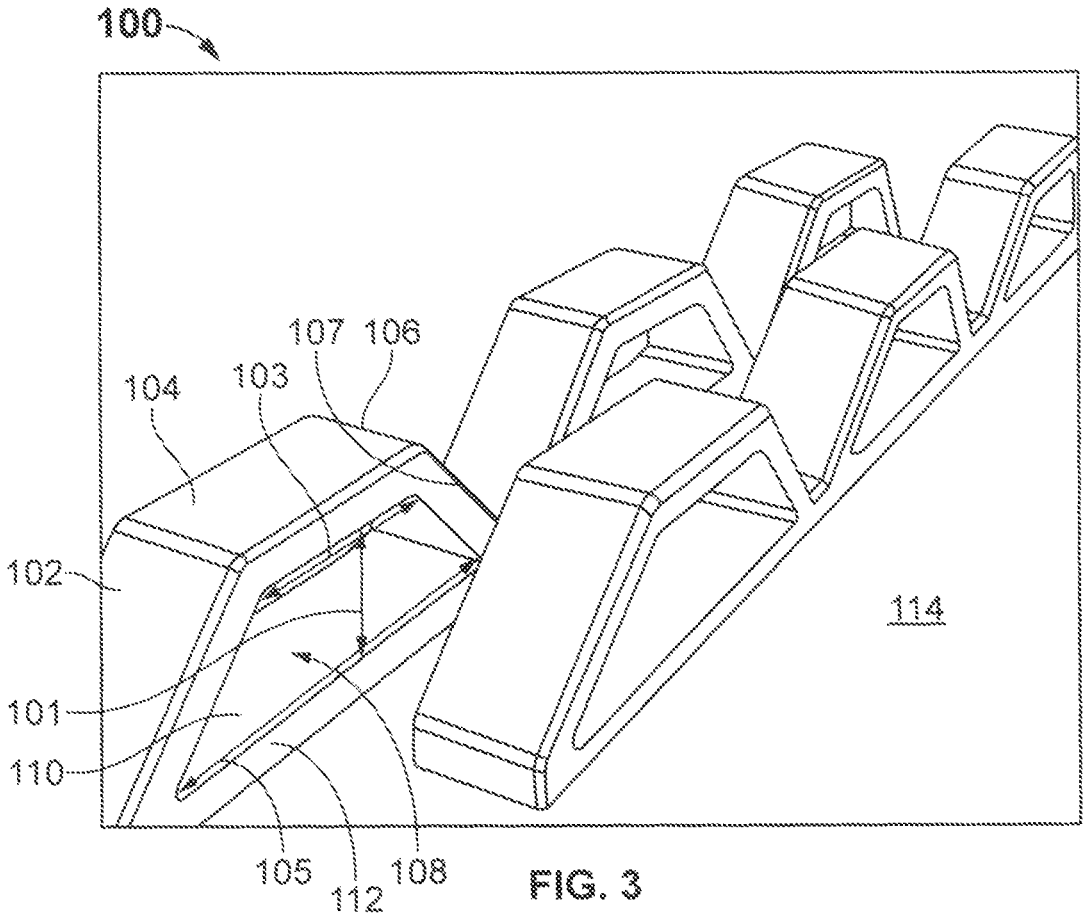
FIG. 3 is a side view of a depiction of a particular illustrative embodiment of the invention.

Turning now to FIG. 3, FIG. 3 is a side view of a depiction of a particular illustrative embodiment of the invention. As shown in FIG. 3 each angular cap support piece has four sides forming an opening 108 formed as a trapezoid having four sides, each angular opening having a first side piece 102, a top piece 104, a second side piece 107 and a bottom piece 112. The top and bottom pieces of the angular opening are parallel. The side pieces of the cap support are not parallel and join to shorter top side to the longer bottom side forming a trapezoidal shaped opening to receive the cap bill. The side pieces of the angular opening formed by the angular cap support are joined to bottom piece 112 of the angular opening, the bottom piece of the angular opening formed by the angular cap support having a top edge 110 which forms the bottom surface of the angular opening to receive a bottom of a bill 127 of a cap. The bottom piece of the angular cap support is elongated to form the bottom of the angular opening for storing adjacent stacks of caps. A bottom side of the bottom piece attaches to a vertical wall 114 or another surface. In another particular embodiment, the angular cap support is attached to a fence in front of a dugout on a baseball field for storage of the baseball cap or a stack of caps during a baseball game while the owner of the stored cap is seated in the dugout. In a particular illustrative embodiment of the invention, a large number of cap supports, 10 or more, are each formed by a side piece 102, top piece 104 and side piece 107, all of which are attached to a single bottom piece 112 for storing 10 or more stacks of caps, one stack per cap support attached to the single bottom plate. The cap support does not deform a shape of the baseball bill cap, and thus stores multiple caps in stacks or singularly on a single cap support without deforming the shape of the baseball cap bills stored in the cap support. In a particular illustrative embodiment of the invention, the cap supports are rigid.

Each cap support is also designed wider towards the back of the cap support as to accommodate caps with a flat bill, or curved bill. In another particular illustrative embodiment of the invention, there is a partial scoop out of the front of the cap bill support as to allow the dome of the cap to engage the scooped out portion of the baseball caps so that the stored baseball caps sit deeper into the cap bill support providing greater stability. In a particular embodiment of the invention, the cap bill support attaches to a vertical surface, which is not necessarily a wall, because a user could also create a freestanding unit with a vertical plane on it somewhere and attach the cap bill support it to the vertical plane of the freestanding unit. The cap support design can be duplicated with a shared back supporting back plate so that one shared back supporting plate unit has multiple cap bill supports on one shared back supporting plate. A keyhole slot in the back of the cap bill support is provided so that one or more of the cap bill supports can be mounted together on a back supporting plate as a part of the mounting system. In a particular illustrative embodiment of the invention, the apparatus stores multiple caps as a stack of caps in each cap support so each cap is stored above and behind and substantially inside of the hat below it in the cap support, and a lower hat already inserted into the cap support provides support for the stack of caps above it in a stack that are stored substantially inside of the lower cap inside the cap support directly beneath a second or subsequent cap stored in a stack of caps in an cap support.

Figure 4:
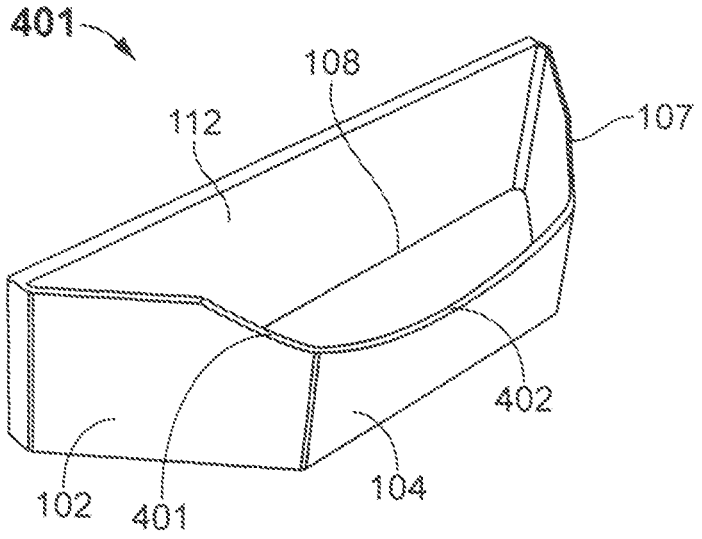
FIG. 4 is a side view of a depiction of a particular illustrative embodiment of the invention.

FIG. 4 is a side view of a depiction of a particular illustrative embodiment of the invention. As shown in FIG. 4, there is a scooped out section 402 of the front section 104 of the cap support 108 as to allow the hats to sit deeper into the frame, providing greater stability. As shown in FIG. 4, the cap support includes but is not limited to a back member 112, a front member 104 which is shorter than the back member 112. A first side section 102 connects a first end of the back section 112 to a first end of the front section 104. A second side section 107 connects a second end of the back section 112 to a second end of the front section 104.

Figure 5:
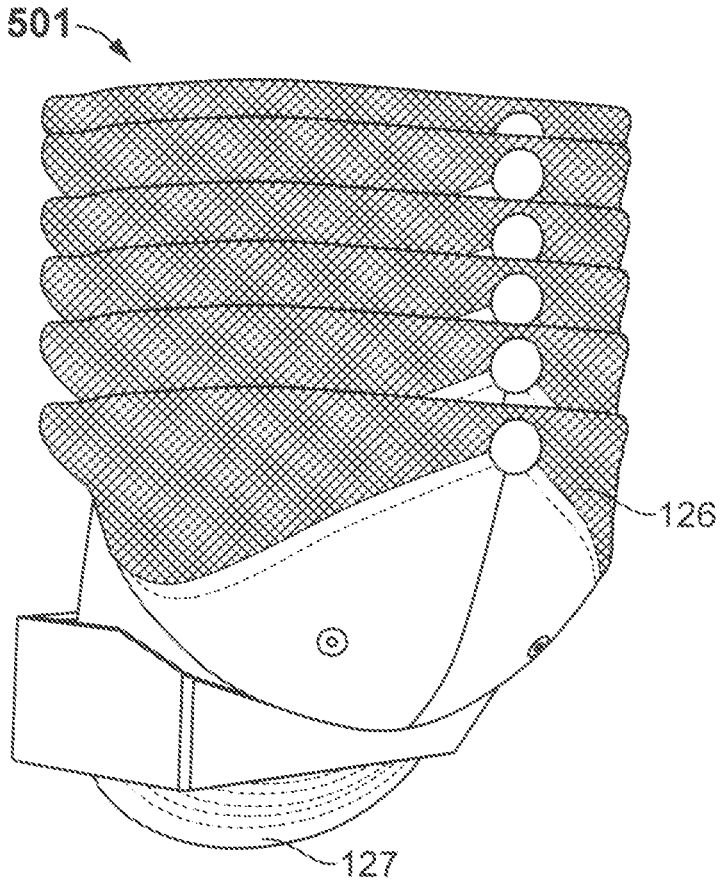
FIG. 5 is a side view of a depiction of a particular illustrative embodiment of the invention.

FIG. 5 is a side view of a depiction of a particular illustrative embodiment 501 of the invention. As shown in FIG. 5, a stack of caps 126 is stored in a cap support 108 attached to a flat surface (not shown). The dome of the cap fits into the scooped out portion 402 and provides additional support to the stack of caps. In alternative embodiments of the invention, the front wall does not have a scooped out portion and instead has a straight edge at the top of the front wall. In alternative embodiments, the front wall is flexible strap such as a leather strap instead of a rigid front wall made of plastic or another rigid material.

Figure 6:
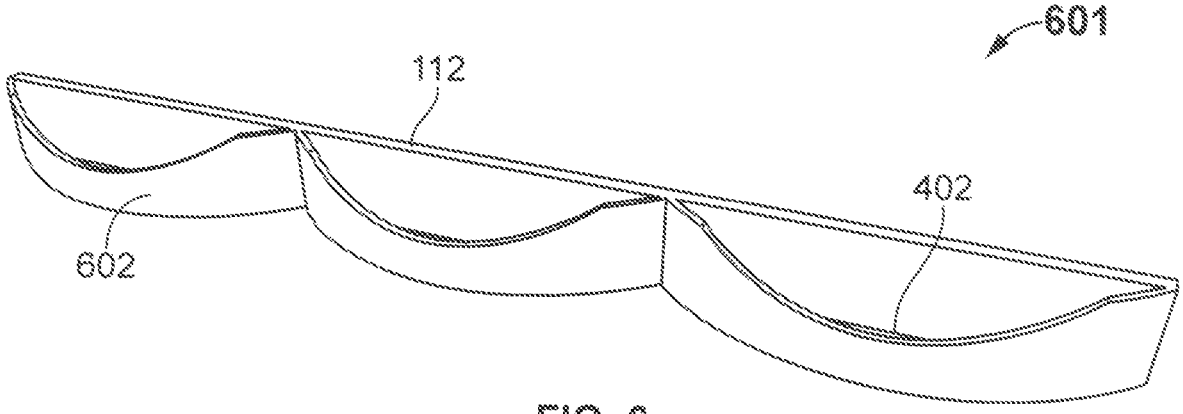
FIG. 6 is a side view of a depiction of a particular illustrative embodiment of the invention.

FIG. 6 is a side view of another particular embodiment of the invention, wherein the front and sides form the cap support form an arcuate member 602 having a scooped out portion 402 on each arcuate front member 602. As shown in FIG. 6, in a particular illustrative embodiment three cap supports having an arcuate front member 602 are joined on a single back piece 112.

Figure 7:
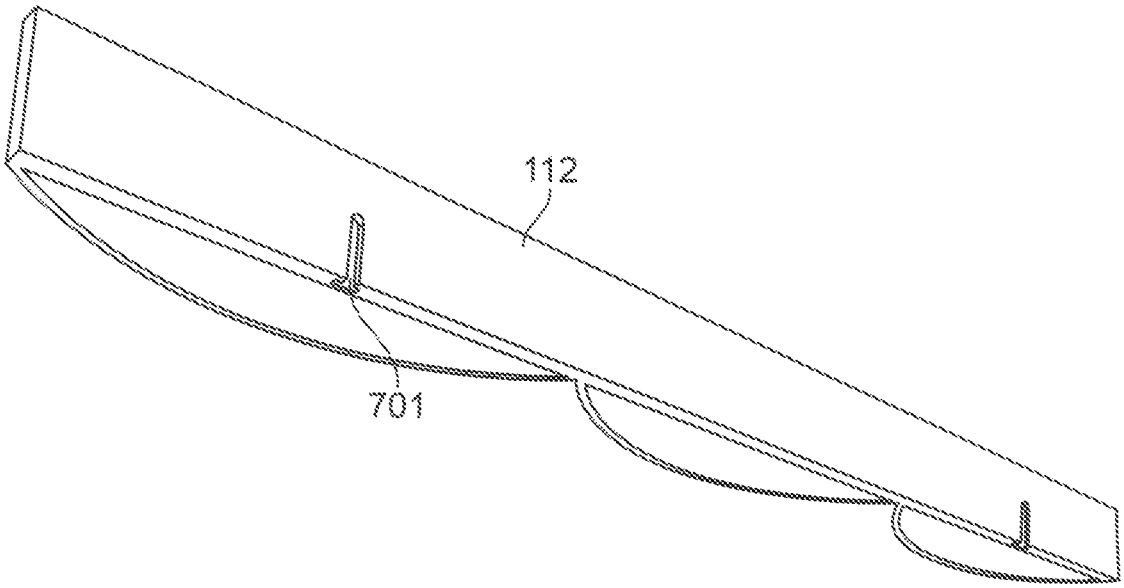
FIG. 7 is a side view of a depiction of a particular illustrative embodiment of the invention.
Figure 8:
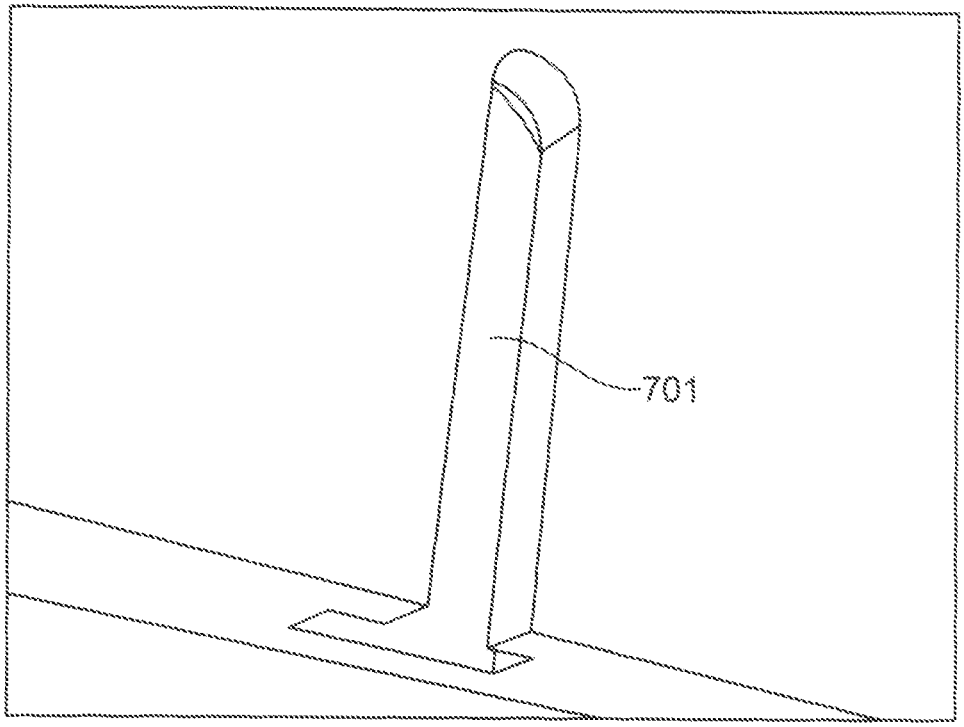
FIG. 8 is a side view of a depiction of a particular illustrative embodiment of the invention.

FIG. 7 depicts another particular illustrative embodiment, wherein a pair of keyhole slots 701 are provided for mounting the back support member 112 on a screw or hook attached to a vertical wall or fence. The keyhole slots are provided on the back support members 112 shown in FIG. 1-6 for an arcuate cap support front and angular cap supports. FIG. 8 depicts a detail drawing of the keyhole slot 701.

Figure 9A:
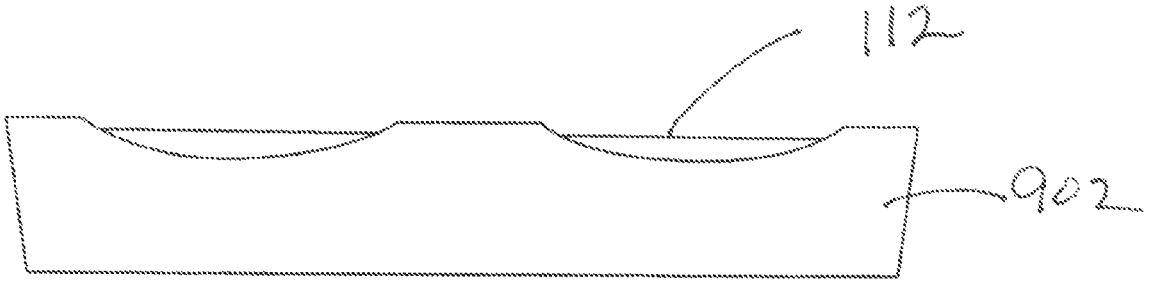
FIGS. 9A and 9B are side views of a depiction of a particular illustrative embodiment of the invention.
Figure 9B:
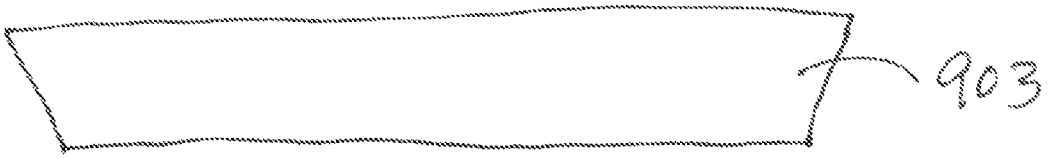

FIGS. 9A and 9B are side views of a depiction of a particular illustrative embodiment of the invention. FIG. 9A is a front view of an alternative illustrative embodiment of the invention showing an elongated front wall 902 attached to 112 for holding multiple stacks of baseball caps. In an alternative embodiment of the invention, as shown in FIG. 9B, the elongated front wall 903 has a straight top edge and does not have a scooped out portion.

Figure 10:
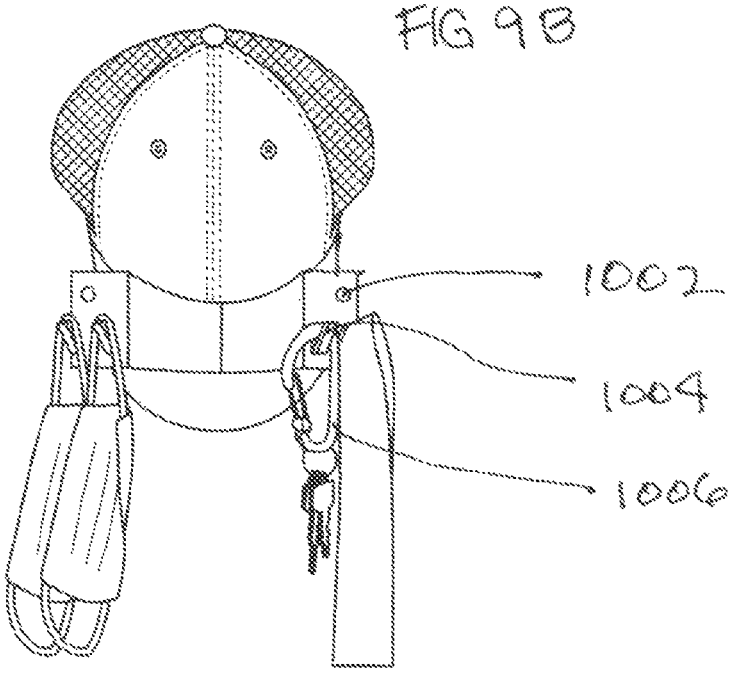
FIG. 10 is a side view of a depiction of a particular illustrative embodiment of the invention.

FIG. 10 is a front view of an alternative illustrative embodiment of the invention depicting a front wall for with front mounting holes 1002 for attaching the invention to a wall and hooks 1004 for hanging accessories such as keys 1006. In an alternative embodiment of the invention, the front wall has a straight top edge and does not have a scooped out portion.

Figure 11:
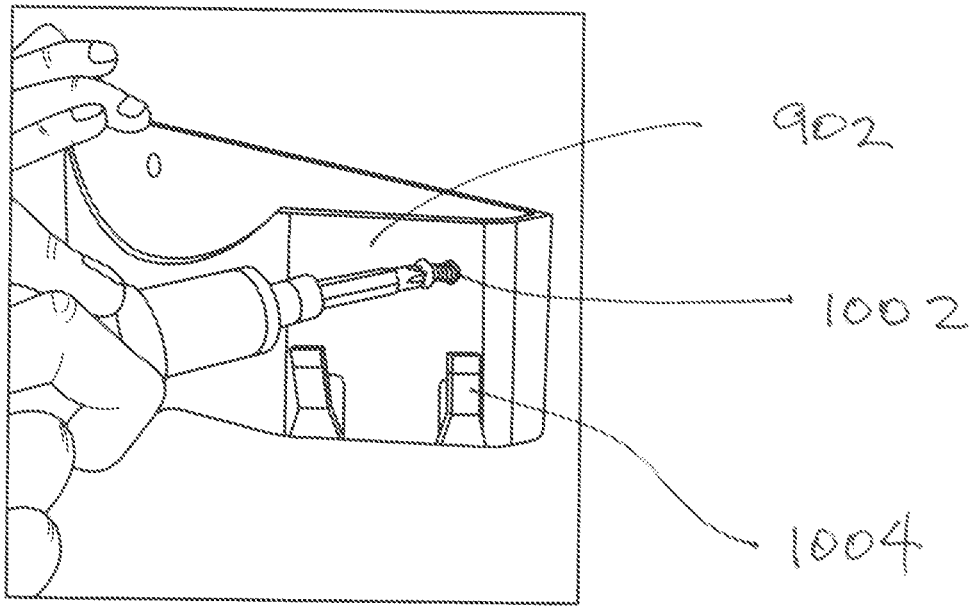
FIG. 11 is a side view of a depiction of a particular illustrative embodiment of the invention.

FIG. 11 is a front view of an alternative illustrative embodiment of the invention showing a front wall for with front mounting holes for attaching the invention to a wall. In an alternative embodiment of the invention, the front wall has a straight top edge and does not have a scooped out portion.

Figure 12:
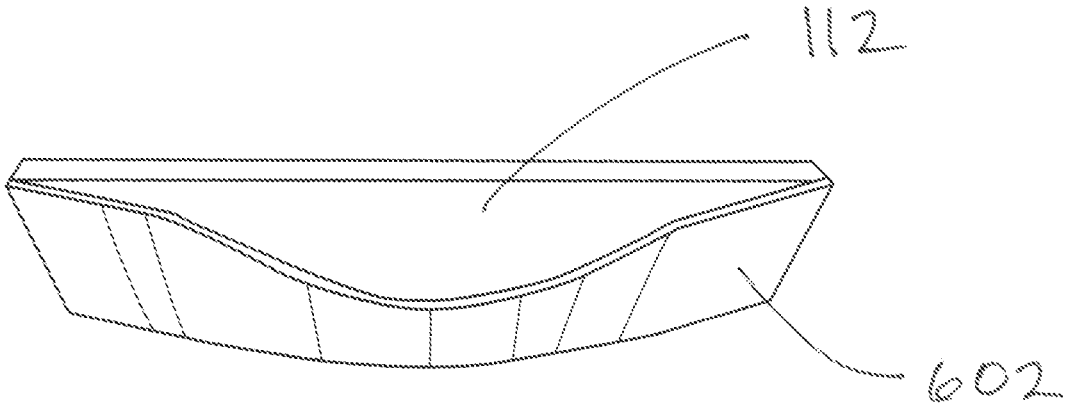
FIG. 12 is a side view of a depiction of a particular illustrative embodiment of the invention.

FIG. 12 is a front view of an alternative illustrative embodiment of the invention showing a front wall made of flexible material instead a rigid material such as plastic or metal. In an alternative embodiment of the invention, the front wall has a straight top edge and does not have a scooped out portion. In a particular illustrative embodiment front wall is a flexible leather material.

In a particular illustrative embodiment of the invention, the apparatus described herein is manufactured with the bottom of the opening a little smaller than the opening in the top of, allowing for easier removal the invention from an injection mold. This adaptation makes the walls of the opening for the brim of the cap to not be perfectly parallel to each other.

In a particular illustrative embodiment of the invention, in order to facilitate the manufacture the product in plastic in an injection mold, the front and back walls are slightly angled from top to bottom so that the bottom of the opening is smaller than the top of the opening. This allows the unit to have less friction when exiting the injection molding machine. However, when we make the product out of wood, then the front and back walls of the opening are parallel to each other from top to bottom. In another particular embodiment of the invention there is no scoop out of the front wall and the front wall has a top straight edge instead of a scooped out portion.

A first baseball cap leans away from the substantially vertical surface so that a dome of a second baseball cap inserts into the cap support behind and above the first baseball cap so that the folded inner dome of the first baseball cap supports the front outer dome of the second baseball cap to form a stack of baseball caps in the cap support so that the shapes of the bills of the baseball caps are not altered.

In another particular embodiment of the invention, the front wall does not even require a back wall of the product, but only the front wall. In this embodiment the front wall is attached directly to a vertical surface, such as a bedroom wall. It could be a curved or angular front wall with or without the scooped out top of the front wall. If that portion attached directly to the wall, the unit would still operate just fine without the back wall.

A plurality of accessories such as key hooks, tie hooks or rods, etc. are attached to the front wall of the hat rack.

In another particular embodiment of the invention, several different alterations to how the rack can be mounted to the wall, such as extending the back wall of the hat rack to the left and right of the unit as wings and screwing those extended "wings" into the wall. In another particular embodiment of the invention the hat rack is attached to a vertical surface by putting screws through the back wall of the unit without wings, etc. into a vertical surface.

In another particular embodiment of the invention the front wall of the hat rack is one continuous front wall with several scoops out of it side by side, wherein each scoop is used to place a hat or stack of hats side by side. In an alternative embodiment of the invention the continuous front wall has a straight top edge and no scooped out portions. The continuous front wall with a straight top edge and no scooped out portions is used to hold a plurality of stacks of caps side by side.

The front or back wall can be of different heights and still be effective. Different artwork can be placed on any part of the hat rack.

In another particular embodiment of the invention, the front wall and the back wall are not a solid frame. It can a flexible strap attached horizontally to a vertical surface, that receives the bill of a baseball cap, or stack of baseball caps.

An illustrative embodiment of an apparatus is disclosed, including but not limited to a trapezoidal-shaped cap support forming a trapezoidal-shaped angular opening for receiving a bill of a baseball cap, wherein the trapezoidal-shaped cap support and the trapezoidal-shaped angular opening have two parallel sides comprising a top side and bottom side wherein the top side is shorter than the bottom side; and a surface, wherein the trapezoidal-shaped cap support is attached to the surface and supported by the surface. In another illustrative embodiment of the apparatus the bottom side of the trapezoidal-shaped angular opening is wide enough to accept a bill of a baseball cap when the bill is flattened out. In another illustrative embodiment of the apparatus, the apparatus further includes but is not limited to a plurality of trapezoidal-shaped cap supports attached to the surface, wherein each trapezoidal-shaped cap support receives and supports a stack of baseball caps. In another illustrative embodiment of the apparatus, a distance between the top side and the bottom side of the trapezoidal-shaped cap support is wider than the depth of a curved baseball cap bill.

In another illustrative embodiment of the apparatus, a scooped out curved portion is formed in the top side of the trapezoidal-shaped cap support, wherein the scooped out curved portion faces up when attached to the surface so that the curved portion of a baseball cap bill faces down and fits into the scooped out portion of the cap support and supports the baseball cap bill. In another illustrative embodiment of the apparatus the trapezoidal-shaped cap support is removably attached to the surface so that the trapezoidal-shaped cap support is moveable on the surface for arranging a plurality of trapezoidal-shaped cap supports on the surface. In another illustrative embodiment of the apparatus the trapezoidal-shaped cap support is attached to the surface with hook and loop fastener. In another illustrative embodiment of the apparatus the trapezoidal-shaped cap support is magnetically attached to the surface.

In another illustrative embodiment of the apparatus the trapezoidal-shaped cap support further includes but is not limited to a keyhole slot formed in the bottom of the trapezoidal-shaped cap support wherein the trapezoidal-shaped cap support is attached to the surface with a screw in the surface that fits into the keyhole slot. In another illustrative embodiment of the apparatus the trapezoidal-shaped cap support further includes but is not limited to a keyhole slot formed in the bottom of the trapezoidal-shaped cap support wherein the trapezoidal-shaped cap support is attached to a dug out fence with a hook attached between the dugout fence and the trapezoidal-shaped cap support.

An illustrative embodiment of a method is disclosed including but not limited to placing a bill of a baseball cap into a trapezoidal-shaped cap support forming a trapezoidal-shaped angular opening for receiving a bill of a baseball cap, wherein the trapezoidal-shaped cap support and the trapezoidal-shaped angular opening have two parallel sides comprising a top side and bottom side wherein the top side is shorter than the bottom side and a surface, wherein the trapezoidal-shaped cap support is attached to the surface and supported by the surface. In another illustrative embodiment of the method, the bottom side of the trapezoidal-shaped angular opening is wide enough to accept a bill of a baseball cap when the bill is flattened out.

In another illustrative embodiment of the method, the method further includes but is not limited to attaching a plurality of trapezoidal-shaped cap supports to the surface, wherein each trapezoidal-shaped cap support receives and supports a stack of baseball caps. In another illustrative embodiment of the method, a distance between the top side and the bottom side of the trapezoidal-shaped cap support is wider than the depth of a curved baseball cap bill. In another illustrative embodiment of the method, the method further includes but is not limited to placing the baseball cap bill into a scooped out curved portion formed in the top side of the trapezoidal-shaped cap support, wherein the scooped out curved portion faces up when attached to the surface so that the curved portion of a baseball cap bill faces down and fits into the scooped out portion of the cap support and supports the baseball cap bill.

In another illustrative embodiment of the method, the method further includes but is not limited to moving the trapezoidal-shaped cap support on the surface for arranging a plurality of trapezoidal-shaped cap supports on the surface. In another illustrative embodiment of the method, the trapezoidal-shaped cap support is attached to the surface with hook and loop fastener. In another illustrative embodiment of the method the trapezoidal-shaped cap support is magnetically attached to the surface. In another illustrative embodiment of the method, the trapezoidal-shaped cap support further includes but is not limited to attaching to trapezoidal-shaped surface with a screw in the surface that fits into the keyhole slot, wherein the keyhole slot is formed in the bottom of the trapezoidal-shaped cap support. In another illustrative embodiment of the method, the trapezoidal-shaped cap support further includes but is not limited to attaching the trapezoidal-shaped cap support to a dug out fence to a hook attached between the dugout fence and the keyhole slot formed in the bottom of the trapezoidal-shaped cap support.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived there from, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover all adaptations or variations of various embodiments. Combinations of the above embodiments, and other embodiments not specifically described herein, will be apparent to those of skill in the art upon reviewing the above description. The Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In addition, in the foregoing. Detailed Description, various features are grouped together in a single embodiment for streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. An apparatus comprising:

an arcuate cap support forming an arcuate opening for receiving a first baseball cap, wherein the first baseball cap further comprises a dome and bill, wherein the cap support is attached to a substantially vertical surface and wherein the first baseball cap is supported by a top surface of the cap support, wherein the top surface of the cap support holds the first baseball cap substantially parallel to the substantially vertical surface, wherein the first baseball cap leans away from the substantially vertical surface and wherein a top edge of the top surface of the cap support supports only the dome of the first baseball cap so that a shape of the bill of the first baseball cap is not altered, wherein the cap support is wider than the bill of the first baseball cap and configured to accept the bill of the first baseball cap when the bill of the first baseball cap is flattened out.

2. The apparatus of claim 1, wherein the cap support receives and supports the bill and dome of the first baseball cap, wherein the first baseball cap leans away from the substantially vertical surface so that a bill and dome of a second baseball cap inserts immediately behind and above and into the bill and dome of the first baseball cap on the cap support so that the dome and bill of the first baseball cap supports the dome and bill of the second baseball cap to form a stack of baseball caps in the cap support so that a shapes of the bills of the first and second baseball caps are not altered.

3. The apparatus of claim 1, wherein the cap support is made of a flexible material.

4. The apparatus of claim 1, wherein the cap support is made of an inflexible material.

5. The apparatus of claim 1, wherein the arcuate cap support further comprises a top edge and a front wall surface, wherein a scooped out portion is formed on the top edge of the front wall surface of the cap support wherein the scooped out portion receives and supports the first baseball cap.

6. The apparatus of claim 1, the apparatus further comprising:

hooks attached to the cap support for hanging accessories.

7. The apparatus of claim 1, wherein the cap support has holes drilled in it so that the cap support is configured to be attached with screws to the substantially vertical surface.

8. The apparatus of claim 1, wherein the top surface of the cap support has a straight upper edge for receiving the bill of the first baseball cap, wherein the dome of the baseball cap rests on the straight upper edge of the cap support.

9. The apparatus of claim 1, wherein the top surface of the cap support has a straight upper edge having a scooped out portion for receiving the first baseball cap, wherein the baseball cap rests on the scooped out portion of the straight upper edge of the cap support.

* * * * *